US009307626B2

(12) United States Patent
Cornwell

(10) Patent No.: US 9,307,626 B2
(45) Date of Patent: Apr. 5, 2016

(54) SYSTEM FOR GENERATING ELECTROMAGNETIC WAVEFORMS, SUBATOMIC PATICLES, SUBSTANTIALLY CHARGE-LESS PARTICLES, AND/OR MAGNETIC WAVES WITH SUBSTANTIALLY NO ELECTRIC FIELD

(75) Inventor: James Cornwell, Inyokern, CA (US)

(73) Assignee: Kaonetics Technologies, Inc., Inyokern, CA (US)

( * ) Notice: Subject to any disclaimer, the term of this patent is extended or adjusted under 35 U.S.C. 154(b) by 715 days.

(21) Appl. No.: 13/452,650

(22) Filed: Apr. 20, 2012

(65) Prior Publication Data

US 2012/0212130 A1 Aug. 23, 2012

Related U.S. Application Data

(63) Continuation of application No. PCT/US2010/053826, filed on Oct. 22, 2010.

(60) Provisional application No. 61/254,449, filed on Oct. 23, 2009.

(51) Int. Cl.
*H01J 25/50* (2006.01)
*H05H 1/46* (2006.01)

(52) U.S. Cl.
CPC ..... *H05H 1/46* (2013.01)

(58) Field of Classification Search
USPC ..... 315/39.51
See application file for complete search history.

(56) References Cited

U.S. PATENT DOCUMENTS 4,705,989 A * 11/1987 Takada ..... H01J 23/15 313/341
4,747,712 A * 5/1988 Gonoh ..... G01K 7/16 219/712
4,804,431 A * 2/1989 Ribner ..... H01J 37/32192 118/50.1
4,891,557 A * 1/1990 Nobue ..... H01J 23/48 315/39.51
4,988,922 A * 1/1991 Shoda et al. ..... 315/223
5,019,680 A * 5/1991 Morino ..... H05B 6/6494 219/726

(Continued)

OTHER PUBLICATIONS

International Preliminary Report on Patentability and Written Opinion PCT/US2010/053826, Apr. 24, 2012.

(Continued)

*Primary Examiner* — Tung X Le
*Assistant Examiner* — Srinivas Sathiraju
(74) *Attorney, Agent, or Firm* — Steven R. Vosen

(57) ABSTRACT

The present invention is directed towards devices, systems and methods which produce electromagnetic waveforms including radio-frequency waves, microwaves and electromagnetic waves having no field current or electric field (magnetic waves) and subatomic and/or charge-less particles. In one embodiment, the system and method produces a "charge-less" propagating "magnetic" wave and/or charge-less particles and/or subatomic particles which have demonstrated high utility in the structural modification of both solids and liquids for materials processing. The energy generator according to one embodiment comprises a magnetron emitter hermetically sealed in a housing and supplied with a continuous dirty or erratic voltage signal to cause the magnetron emitter to operate erratically and unstably as a broad band signal generator whereby electromagnetic waves are produced in the hermetically sealed housing which facilitates and produces a plasma above the cathode of the magnetron emitter. The plasma preferably expands and contracts (oscillating) within the housing.

21 Claims, 8 Drawing Sheets

(56) References Cited

U.S. PATENT DOCUMENTS 5,233,144 A * 8/1993 Morino ..... H05B 6/6494 219/730
5,272,299 A * 12/1993 Ovadia ..... H05B 6/6473 126/21 A
5,844,366 A * 12/1998 Ochiai ..... H01J 23/15 315/39.51
6,060,833 A 5/2000 Velazco
6,433,321 B1 * 8/2002 Lee et al. ..... 219/715
6,445,596 B1 * 9/2002 Mihara et al. ..... 363/21.01
6,856,095 B2 * 2/2005 Zeng et al. ..... 315/70
6,872,929 B2 * 3/2005 Neculaes ..... H01J 23/10 219/679
7,148,455 B2 12/2006 Scalese et al.
7,312,427 B2 * 12/2007 Suenaga et al. ..... 219/710
7,339,146 B2 * 3/2008 Aisenbrey ..... H05B 6/66 219/678
7,589,470 B2 9/2009 Oksuz et al.
7,893,621 B2 * 2/2011 Schamiloglu ..... H01J 23/05 219/678
8,675,818 B2 * 3/2014 Wassom ..... H01J 35/16 378/119
8,963,060 B2 * 2/2015 Feilders ..... B01L 7/00 219/700
2002/0108949 A1 * 8/2002 Gedevanishvili et al. .... 219/759
2004/0206754 A1 * 10/2004 Neculaes ..... H01J 23/10 219/747
2009/0238998 A1 9/2009 Stowell et al.

OTHER PUBLICATIONS

International Search Report and Written Opinion PCT/US2010/053826, Dec. 22, 2010.

* cited by examiner

SYSTEM FOR GENERATING ELECTROMAGNETIC WAVEFORMS, SUBATOMIC PATICLES, SUBSTANTIALLY CHARGE-LESS PARTICLES, AND/OR MAGNETIC WAVES WITH SUBSTANTIALLY NO ELECTRIC FIELD

CROSS-REFERENCE TO RELATED APPLICATIONS

This application is continuation of Application No. PCT/US10/53826, filed Oct. 22, 2010, which claims the benefit and priority of U.S. Provisional Application No. 61/254,449, filed on Oct. 23, 2009 and entitled "Electromagnetic Resonator with Particle Field Isolated from Electromagnetic Waves," the contents of these applications are incorporated by reference.

This application also incorporates by reference in its entirety PCT/US2008/012678 filed Nov. 12, 2008.

FIELD OF THE INVENTION

The subject matter of the present invention relates generally to a device, system and method to produce directed-energy including the production of electromagnetic wave forms, including radio frequency waves, microwaves, acoustic waves and/or photons, and in one embodiment subatomic and charge-less particles including a pure magnetic wave with no or substantially no electric field, referred to as a charge-less magnetic wave.

BACKGROUND OF THE INVENTION

In the 1940's, Raytheon Corporation conducted extensive research and experimentation on a new device called a magnetron for use in radar applications. The magnetron produced microwaves. Research has resulted in the development of magnetrons which generate and systems to contain the microwave energy for industrial and domestic use.

After nearly 70 years of research, development and experimentation, microwaves are used in numerous industrial, drying, cooking, communication and sintering processes. Microwaves, however, are not appropriate or the best practice in every application. There is, however, a resurgence of microwave, photon and directed-energy research underway discovering an extensive amount of new material processing methodologies.

SUMMARY OF THE INVENTION

One object of the present invention is to create an energy generator or directed-energy system. The system or device may include a broad-band signal generator that produces a wide range of electromagnetic wave forms including radio waves, microwaves, acoustic waves and/or photons. Another object of the present invention is to construct an apparatus that can produce a plasma that may include highly ionized gas, radicals and electromagnetic wave forms, including radio frequency waves, microwaves, acoustic waves and/or photons, as well as subatomic particles, and charge-less particles. A further object of the present invention is to create a device, system and method to produce a magnetic wave propagation with no electric field or substantially no electric field preferably having subatomic and charge-less particles that may be described as a "charge-less" magnetic wave.

In one embodiment a broadband signal generator is described which includes a magnetron having a cathode for emitting radio frequency signals, and a power supply configured to generate an excitation signal to control the output of the magnetron, wherein the excitation signal to the magnetron comprises a dirty signal having or super imposed with a noise signal which makes the magnetron operate erratically and produce electromagnetic waves outside its typical operating frequency. The excitation signal supplied to the magnetron may include a chopped alternating current signal, a square wave, and a square wave superimposed upon a sinusoidal wave. The dirty signal preferably has a sharp transition or change in voltage and may comprise an alternating current voltage signal or a direct current voltage signal. Preferably, the dirty signal to the magnetron makes it operate erratically and produce electromagnetic waves having a frequency from at least about 200 KHz to about 6 GHz, although other ranges of frequency are contemplated.

In another embodiment, a directed energy system is described which comprises: a housing having one or more walls forming a cavity and preferably an opening in the one or more walls of the housing, although the housing can completely enclose a cavity; a signal generator configured to emit at least one of electromagnetic waves, radio frequency waves, microwaves, acoustic waves and photons into the cavity in the housing; and an optional covering member comprising material that at least partially covers the optional opening in the walls of the housing, wherein the signal generator is configured and positioned in the housing to produce a plasma, wherein energized particles are formed having substantially zero charge. The signal generator, the housing and the covering element preferably are configured and arranged to reflect, redirect, deflect and refract at least one of the electromagnetic waves, the radio frequency waves, the microwaves, the acoustic waves and the photons back to the source of the electromagnetic waves, radio frequency waves, microwaves, acoustic waves and photons emitted in the housing to facilitate the formation of the plasma and energized particles preferably having no charge or substantially zero charge.

In a further aspect of this embodiment, the housing preferably is formed of a metal, metal alloy or coated with a metal or metal alloy and preferably is hermetically sealed. The optional covering member preferably comprises at least one of the following group of materials, a metal, metal alloy, dielectric material, Delrin, polycarbonates, plastics, insulators, conductors, electro-positive material, electro-negative material, composites, ceramics, polymers, minerals, and quartz. The signal generator preferably may be a magnetron, Tesla coil, spark gap generator, discharge device, corona discharge device, solid-state power amplifier, gyrotron, traveling wave tube, klystron or free electron laser, although other electromagnetic frequency signal generators are contemplated.

Preferably the signal generator generates a photon particle wave. In one embodiment, the signal generator is configured and positioned in the housing to produce an oscillating plasma field which expands and contracts. The system may further include a power supply configured to generate an excitation signal to control the output of the signal generator. In one preferred embodiment, the signal generator is a magnetron, and the magnetron preferably is driven by a dirty excitation signal that drives the magnetron to produce radio frequency emissions outside its typical narrow operating frequency band that occurs when supplied with a smooth sinusoidal voltage signal. Preferably the magnetron produces electro-magnetic emissions of at least about 200 KHz to about 6 GHz, although other frequency bands are contemplated.

The housing preferably has walls formed of metal or coated with metal, and the signal generator preferably is a magnetron having a cathode supplied with a dirty signal to make it operate erratically and produce electromagnetic waveforms that are not typical of a standard magnetron supplied with 120 volts of smoothly undulating sinusoidal alternating current, more preferably the magnetron is configured and positioned in the housing to produce a plasma between the cathode and one of the walls of the housings. In another preferred embodiment, the cathode of the magnetron has an outer surface and a top surface out of which the electromagnetic waves are emitted, the housing has one or more walls, and the magnetron is configured and positioned within the housing such that the top surface of the cathode and the wall above the top surface define an air gap spacing and the plasma is formed in the air gap spacing, and the magnetron is further configured and positioned within the housing to define a bleed off spacing gap which at least partially quenches the plasma. Preferably, the bleed off spacing gap is less than the air space gap, more preferably the ratio of the air space gap to the bleed-off spacing gap is greater than or equal to about 5:4.

In another embodiment, the cathode is configured and positioned in the housing so that the distance from the top surface of the cathode to the top wall and the distance from the outer side surface of the cathode to each of the side walls are the same. Additionally, the distance in the cavity of the housing from the top surface of the cathode to the top wall preferably is greater than the distance from the outer surface of the cathode to the back wall. The back wall of the housing may optionally be at a non-perpendicular angle with respect to the longitudinal axis of the cathode of the magnetron. In one embodiment, the signal generator is configured to operate at power levels of approximately 1 kilowatt (KW) to approximately 100 KW, although smaller power levels and higher power levels are contemplated.

The housing may further include an optional chamfer plate, and where the signal generator is a magnetron having a cathode having a longitudinal axis, the chamfer plate preferably is at a non-perpendicular angle with respect to the longitudinal axis of the cathode. In one embodiment, the optional chamfer plate is movable with respect to the walls of the housing and the cathode.

The system in one embodiment may further include at least one optional cooling device which may include a heat sink, fan, thermal mass transfer device, heat exchanger, liquid cooling system, or a duel fan peltier thermal mass transfer device, although other cooling device and means are contemplated. The optional cooling device may be associated with or in contact with or coupled to the housing within which the electromagnetic waves, radio frequency waves, microwaves, acoustic waves or photons are produced and/or emitted.

The system in one embodiment, may further include a system to control the intensity of the electromagnetic field in the housing. In one preferred embodiment, the electromagnetic field control mechanism or system may comprise metal tubing. The metal tubing may form a closed system and may include a coil. An aperture may be formed in the housing to receive the electromagnetic waves, radio-frequency waves, microwaves, acoustic waves and photons. A fitting may be used to connect the metal tubing to the housing at the aperture.

In another embodiment, a method of forming a plurality of energized particles having no or substantially no charge and/or subatomic particles, and/or a magnetic wave having no or substantially no electric field is disclosed. The method may include: providing a signal generator for emitting at least one of electromagnetic waves, radio frequency waves, microwaves, acoustic waves and photons from a source; emitting at least one of electromagnetic waves, radio frequency waves, microwaves, acoustic waves and photons from the source into a cavity of a housing having walls; directing at least some of electromagnetic waves, radio frequency waves, microwaves, acoustic waves and photons back toward the source of electromagnetic waves, radio frequency waves, microwaves, acoustic waves and photons; and configuring and positioning the source of the signal generator within the housing to produce a plasma, wherein a plurality of energized particles having no or substantially no charge, and/or subatomic particles and/or a magnetic wave having no or substantially no electric field are formed.

In a preferred embodiment, the signal generator may be a magnetron having its cathode located within the housing, and the method further comprises the step of providing a dirty signal to the magnetron which drives the magnetron to emit energy that is outside its typical 2.45 GHz microwave emission. In the preferred embodiment, the magnetron produces a photon particle wave comprising photons and electrons. In a further preferred embodiment, the method includes the step of producing an oscillating plasma and/or plasma field which contract and/or expand. A magnetron having a cathode may be utilized and, the method may include supplying the magnetron with a dirty signal to make it operate erratically and produce electromagnetic waves outside its typical frequency, and preferably having a frequency from at least about 200 KHz to about 6 GHz, and positioning the cathode within the housing to produce an oscillating plasma field. The method may further comprise supplying the magnetron with a continuous dirty voltage signal to make it operate erratically and produce electromagnetic waves outside its typical operating frequency.

The method preferably further includes hermetically sealing the housing, preferably with air inside the housing, preferably at about one atmosphere of pressure. Other pressures within the housing and other mediums are contemplated, such as for example, helium, argon, etc. Operating the system and method when the cavity in the housing is under vacuum conditions is also contemplated. The housing in one embodiment may have an opening and the opening is covered with a covering member to direct at least some of the electromagnetic waves, radio frequency waves, microwaves, acoustic waves and photons back toward the source of electromagnetic waves, radio frequency waves, microwaves, acoustic waves and photons. The covering member is preferably hermetically sealed. The method may include a further step of positioning the magnetron with respect to the housing so that the cathode in the housing is located closer to one of the back and side walls than to the top wall.

In yet another embodiment, a system for producing charge-less or substantially charge-less particles and/or subatomic particles and/or a magnetic wave with no or substantially no electric field is disclosed which comprises: a magnetron having a cathode to emit electromagnetic waves; a power supply for providing a dirty signal to the magnetron to make the magnetron operate erratically; a housing having one or more walls having an inner surface, the inner surfaces forming an enclosed cavity, at least one or more of the walls being formed of or coated on the inner surface with a metal, wherein the cathode is positioned to emit electromagnetic waves into the cavity and the housing is hermetically sealed, the cathode further being positioned within the housing to produce a plasma between the cathode and one of the walls of the housing.

In the system, the dirty signal preferably makes the magnetron operate outside its typical narrow frequency band which occurs when the magnetron is supplied with a smooth sinusoidal voltage signal, and preferably the dirty signal makes the magnetron operate erratically and produce electromagnetic waves having a frequency from at least about 200 KHz to about 6 GHz. The dirty signal may be a non-sinusoidal component with a sharp change in voltage, and may include a square wave, a chopped sinusoidal wave, a clipped sinusoidal wave, and a triangularly-shaped voltage wave, and may further include a sinusoidal wave out of phase with at least one of a square wave, chopped sinusoidal wave, clipped sinusoidal wave and a triangularly-shaped wave. Other dirty signals that will have the magnetron operate erratically and produce the required electromagnetic emissions are contemplated.

The cathode preferably is configured and positioned within the housing to produce an oscillating plasma field which expands and contracts. The cathode has a top surface and an outer side surface, and the magnetron preferably is configured and positioned within the housing such that the top surface of the cathode and the wall above the top surface define an air gap spacing, the plasma being formed in the air gap spacing, and the cathode further being configured and positioned within the housing to define a bleed off spacing gap which reduces the plasma field. Preferably the bleed-off spacing gap is less than the air space gap, and preferably the ratio of the air space gap to the bleed off spacing gap is greater than or equal to about 5:4. Preferably the housing has a top wall, back wall and at least two side walls, and the cathode is positioned within the housing such that it is closest to the back wall and the back wall defines the bleed off spacing gap for quenching of the plasma. Also, preferably the distance from the cathode to the side walls is the same as the distance from the cathode to the top wall. The housing may also include a front wall, and the cathode preferably is positioned within the housing such that the front wall is positioned further from the cathode than the back wall, the side walls or the top wall. In one embodiment, the front wall may be formed of a different material than at least one of the other walls. The housing may further includes a throat section for improving the acceleration of the magnetic wave of no or substantially no electric field current and/or the charge-less or substantially charge-less particles and/or the subatomic particles. The housing may also have an opening, the opening preferably being hermetically sealed with a cover member, and the covering member may be formed of a different material than the housing.

In one embodiment, the creation of subatomic and charge-less particles is caused by the discharge of an erratically operating magnetron that generates a plasma preferably in a hermetically sealed reactor chamber. The wave mode operation, e.g., the forming of a charge-less magnetic wave with no or substantially no electric field, is due to coupling of these charge-less subatomic particles on radio waves, microwaves, acoustic waves and/or photons. The magnetron preferably induces the radio waves and microwaves in the reactor chamber and the charge-less particles preferably couple to the waves. The presence of the Z-axis "magnetic" field creates higher ionization efficiency and greater electron density than other electromagnetic generation systems. That is, the plasma preferably first forms in the Z direction above the magnetron emitter and then expands in the X and Y plane, preferably symmetrically until it expands to near ARC fault whereby some of the plasma field is bleed off and the plasma contracts such that the plasma repeatedly expands and contracts such that an oscillating plasma is formed.

BRIEF DESCRIPTION OF THE DRAWINGS

The foregoing summary, as well as a brief description of the preferred embodiments of the application will be better understood when read in conjunction with the appended drawings. For the purpose of illustrating the preferred embodiments of the present inventions, and to explain their operation, drawings of preferred embodiments and schematic illustrations are shown. It should be understood, however, that the application is not limited to the precise arrangements, variants, structures, features, embodiments, aspects, methods, and instrumentalities shown, and the arrangements, variants, structures, features, embodiments, aspects, methods and instrumentalities shown and/or described may be used singularly in the device, system or method or may be used in combination with other arrangements, variants, structures, features, embodiments, aspects, methods and instrumentalities. In the drawings.

DETAILED DESCRIPTION OF THE INVENTION

Figure 1:
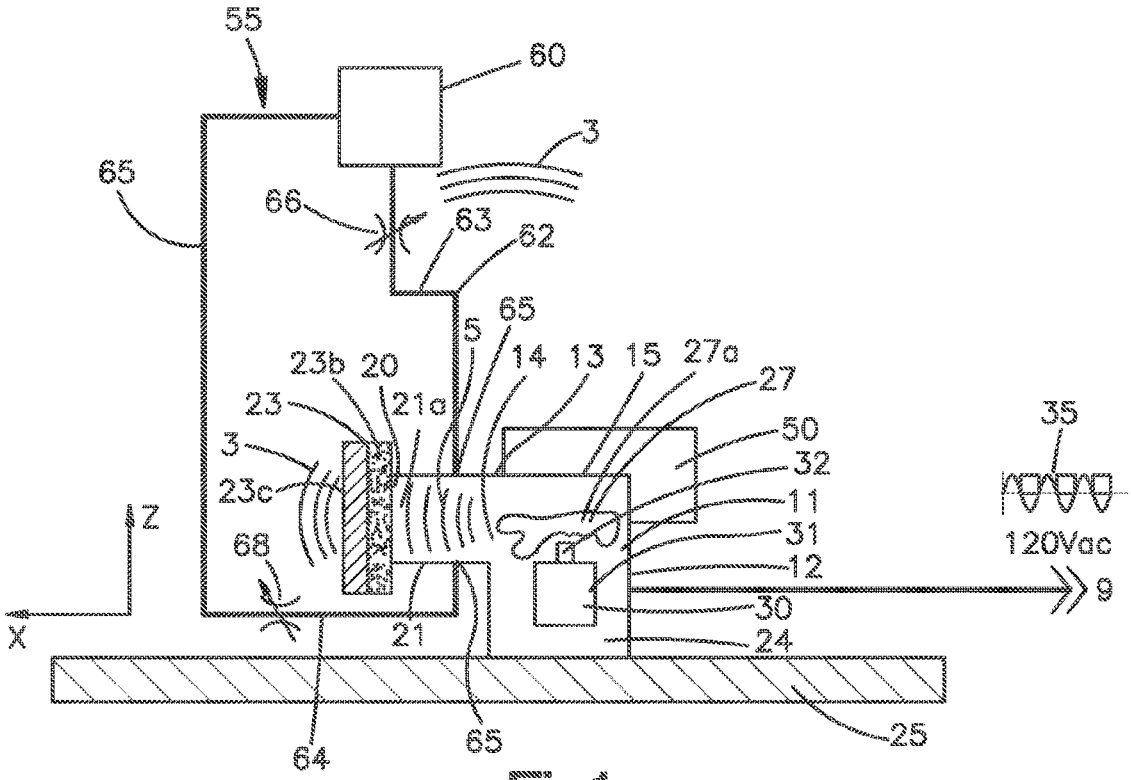
FIG. 1 is a side view of a schematic representation of a cross-section of an energy generator according to an exemplary embodiment of the present invention.

FIGS. 1, 2, 11 and 12 show exemplary preferred embodiments of an energy generator or directed energy system 10 comprising a housing 12 forming a reaction chamber, cavity or reactor 14. A broad band signal generator 30, such as, for example, an erratically operating microwave magnetron emitter 31, is operatively associated with and preferably mounted to the housing 12 for the formation of broad-band waveforms, including, for example, electro-magnetic waves, radio frequency waves, microwaves, acoustic waves and/or photons, within the housing chamber 14. A power supply 9 preferably supplies the broad-band signal generator 30 with electrical power. In one embodiment, the broad-band signal generator 30 may be a standard microwave magnetron 31. Power supply 9 preferably supplies a dirty alternating current voltage signal 35 to the standard microwave magnetron 31 to facilitate and create the erratic and unstable operation of the microwave magnetron which creates electromagnetic waveforms, including broad-band radio-frequency waves, microwaves, acoustic waves and/or photons. The housing 12 may completely surround or enclose the cavity 14, or optionally, one or more openings 20 may be provided in the housing, and optionally one more covering members 23 may hermetically seal and cover one or more openings 20 in the housing 12, preferably a throat opening 20 in the front portion 21 of the housing 12. The dimensions and materials of the housing 12, and the optional one or more covering members 23, influence, facilitate and may create plasma 27, electromagnetic waveforms, radio-frequency waves, acoustic waves, photons, subatomic and/or other charge-less particles, and magnetic waves of substantially zero electric field current, in the reaction chamber 14.

In one embodiment, broad-band signal generator 30 may include any source of radio-frequency energy and electromagnetic waveforms, preferably microwaves and/or photons. Broad-band signal generator 30 may include, for example, known microwave magnetrons; Tesla coils; spark gap generators; corona discharge devices; solid state power amplifiers; gyrotrons; Traveling Wave Tubes (TWTs); Free Electron Lasers (FEL); Klystrons; gas, liquid or solid state lasers; and/or free electron discharges or arcs at the edges of planar antennas or discharge devices.

The broad-band signal generator 30 may be a low power device (less than about 1 KW) or may be a higher power device having energy levels of approximately 1 kilowatt (1 KW) to approximately 100 KW, and even greater, although the scope of the present invention should not be limited by the power input to the energy generator 10 or the power input to the broad-band signal generator 30 unless expressly specified in the claims. The energy generator 10 may include a power supply or power control components 9 to supply the broad band signal generator 30 with power, e.g., a voltage signal 34. In one exemplary and representative embodiment, the power supply 9 may include a DC power supply and DC-to-AC converter. In another exemplary and representative embodiment, the power supply and power control components 9 may supply the broad-band signal generator 30 with a 120 VAC super-imposed with an out of phase clipped (square) wave as shown in FIG. 1. Power supply and power control components 9 are well known in the art.

Figure 4:
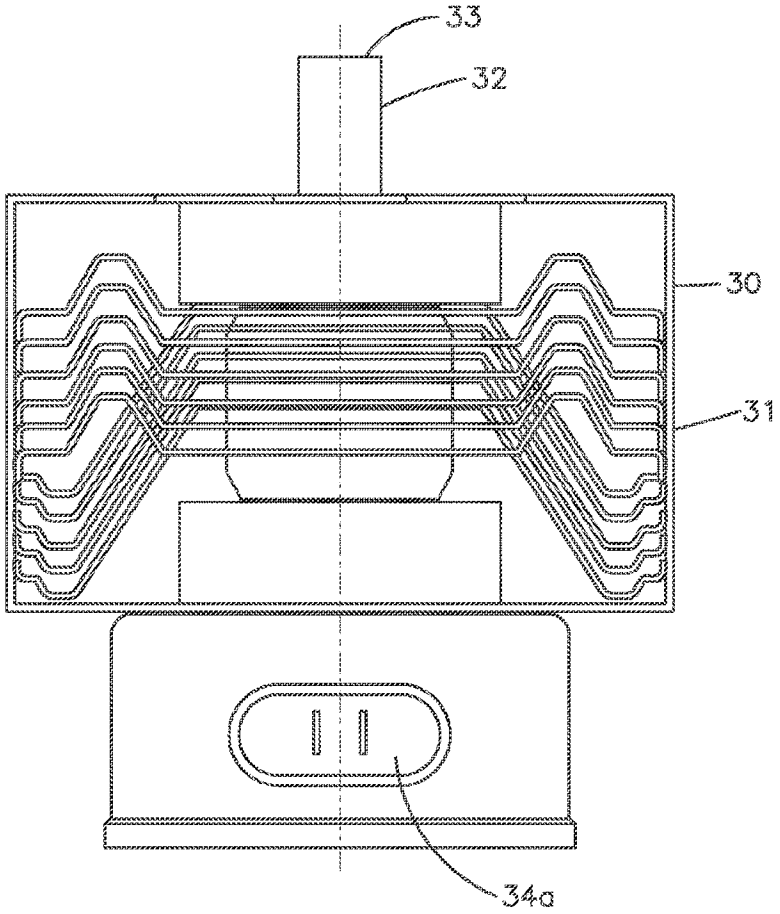
FIG. 4 is a side view of the broad-band signal generator of FIG. 3.
Figure 3:
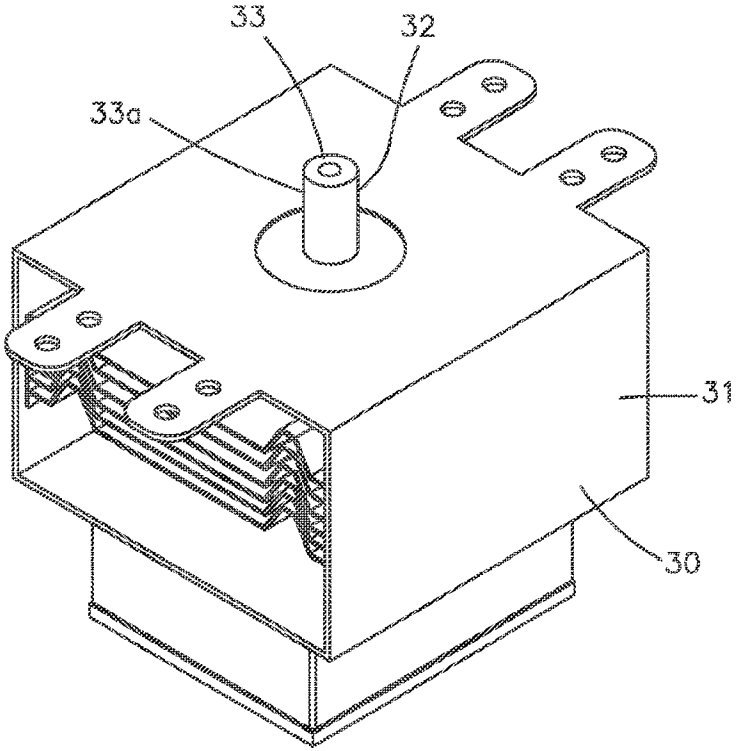
FIG. 3 is a top perspective view of a broad-band signal generator useable in the energy generator of FIGS. 1 and 2.

In one exemplary and representative embodiment, the broad-band signal generator 30 may include a known microwave magnetron emitter 31 as shown in FIGS. 3-4. An example of a standard known magnetron emitter 31, shown in FIGS. 3-4, is available from Panasonic as model 2M261-M32. The magnetron emitter 31 as shown in FIGS. 3-4 has a cathode 32 for emitting the electromagnetic wave forms and a connector 34*a* for supplying the magnetron emitter 31 with power signal 34, 35 from power supply 9. The standard magnetron emitter 31 may be powered by power supply 9 which may include a voltage step-up circuit with a transformer that increases a standard 120 V AC signal to about 1500 volts of alternating current having a sinusoidal waveform. When the magnetron emitter 31 is supplied with a power input 34 of sinusoidal alternating current of appropriate voltage, it typically emits microwaves at a "single" frequency (very narrow frequency band) of about 2.4 GHz. Other magnetrons operating at different power levels and different operating frequencies are contemplated.

To change the operating characteristics of the magnetron emitter 30, the magnetron emitter 30 is supplied with a dirty or erratic voltage signal 35, instead of a smooth sinusoidal alternating current voltage power input 34 that is normally supplied to a microwave magnetron emitter for use in a microwave oven. The dirty voltage signal or dirty power input 35 to the magnetron emitter 31 purposefully makes the magnetron emitter 31 operate erratically such that the magnetron emitter 31 operates as a broad-band electro-magnetic frequency generator 30.

Figure 5A:
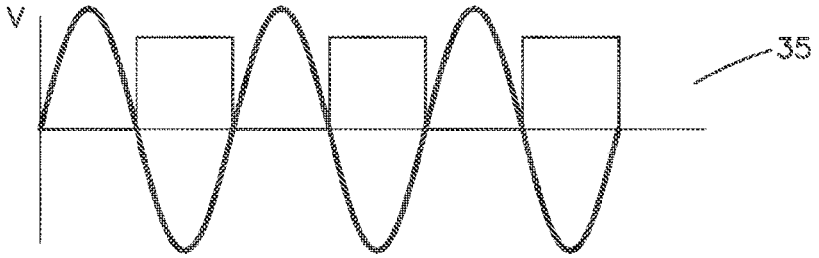
FIG. 5 are examples of voltage input signals to the broad-band signal generator of FIGS. 3 and 4.
Figure 5B:
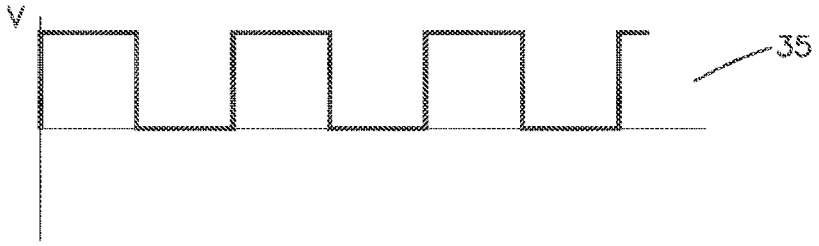
Figure 5C:
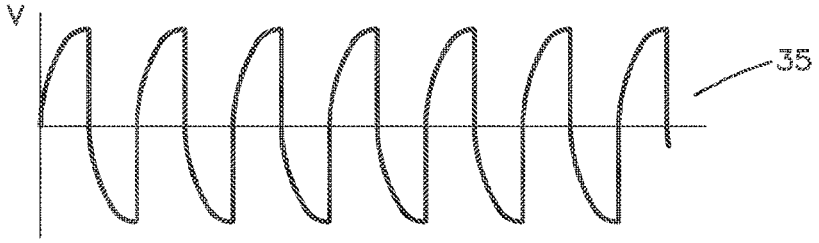
Figure 5D:
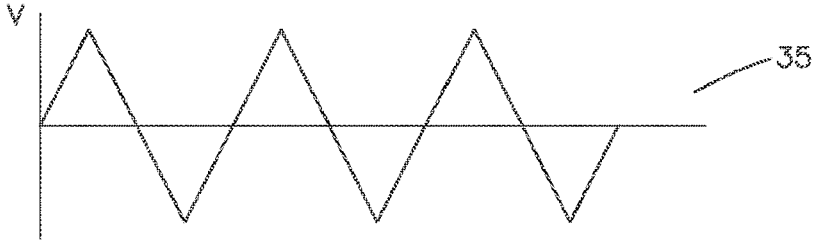
Figure 5E:
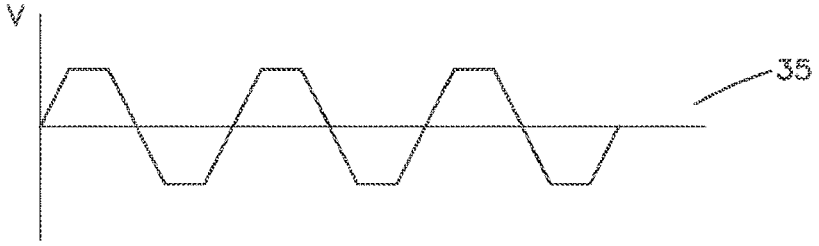
Figure 5F:
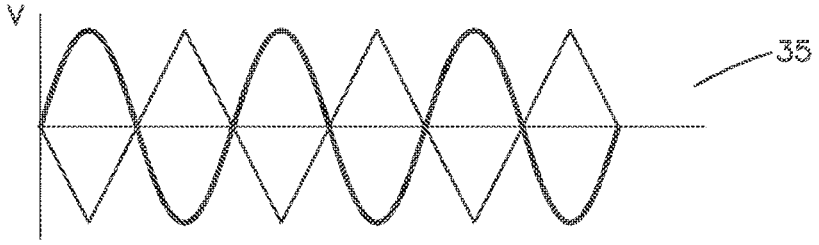

As used herein the dirty or erratic signal 35 refers to a voltage signal with an induced noise signal or induced chopped wave that preferably undergoes sharp voltage transitions and changes, instead of the smoothly varying and transitioning voltage exhibited by a sinusoidal wave. Dirty signal 35 preferably does not smoothly increase or decrease voltage like a sinusoidal waveform, and preferably has one or more sharp transitions in voltage as shown by the exemplary voltage input signals 35 illustrated in FIG. 5. In one embodiment, the dirty signal 35 comprises a voltage input to the magnetron 30 that changes abruptly, dramatically, and/or non-linearly in a short period of time. Examples of dirty signals 35 include stepped, clipped, saw-tooth, triangular, chopped square or square-like voltage signal waves including voltage signals that are alternating current or direct current, and may be alternating current as shown in FIG. 5A, 5C-5F, or direct current as shown in FIG. 5B. Dirty signal 35 may further include clipped, stepped, chopped, saw-tooth, triangular, square or square-like waves super-imposed on sinusoidal waves, and preferably out of phase with the sinusoidal waves, as shown, for example, in FIGS. 5A and 5F, preferably to make the magnetron operate erratically to become a broad-band signal generator 30. For example, a 120 volt alternating-current clipped supply signal 35 as shown in FIGS. 5C and 5E may be used to power magnetron emitter 31. In one example, shown in FIG. 5A, dirty power input signal 35 comprises a direct current CDC) square wave superimposed on an AC sinusoidal voltage signal. The square wave is preferably out of phase with the AC sinusoidal voltage signal, preferably 90° out of phase as shown in FIG. 5A. The square wave is also preferably of similar frequency and amplitude to the A/C sinusoidal voltage signal as shown in FIG. 5A, although the frequency, amplitude or both the frequency and amplitude of the square wave may be different than the frequency or amplitude of the A/C sinusoidal voltage input signal.

Preferably, the signal to the magnetron 30 is a "dirty" voltage signal 35 such that the magnetron 30 operates erratically and unstably, and acts like a broad-band signal generator 30. In practice, the creation of the dirty signal 35 can be accomplished in a number of ways as known by those of skill in the art, including varactors to add the square wave, inverters, dimming switches or a combination of these devices and methods.

When the standard microwave magnetron emitter 31 is supplied with a dirty signal 35, such as, for example, the signals illustrated in FIG. 5, the magnetron emitter 31 preferably will emit radio-frequency waves, microwaves, photons and/or acoustic waves well above, below and including its typical single approximately 2.4 GHz frequency band. When a 120 V AC square wave is supplied to microwave magnetron emitter 31, frequency band widths on the order of 0 to about 10 GHz may be achieved. In one exemplary and representative embodiment, radio frequency waves from about 115 KHz to about 6.1 GHz have been produced by a magnetron emitter 31 feed with a dirty signal 35 of 120 VAC and 20 amps as shown in FIG. 5A. Other frequency ranges below and above the frequency range of about 115 KHz to about 6.1 GHz may be emitted from the magnetron emitter 31 depending upon the signal 35 supplied to the magnetron emitter 31 and how unstable and erratically the magnetron emitter 31 operates.

The broad-band signal generator 30 may be positioned and mounted adjacent to, on or in the chamber 14 of the housing 12 with, for example, standard mechanical mechanisms and fasteners. The use of one or more screws, bolts and compression nuts may be sufficient to secure the broad-band signal generator 30 to the walls 13 of the housing 12. Preferably, the broad-band signal generator 30 is secured in a fixed location and position with respect to the chamber 14, although it is contemplated that the broad-band signal generator 30 may be moveable with respect to the chamber 14 to vary the operation, and the resulting emissions from the broad-band signal generator 30, and the resulting emissions within and out of the chamber 14. In this regard, it is contemplated that the broad-band signal generator 30 may be moved relative to housing 12 and temporarily fixed in or at a position, or the broad band signal generator 30 can move with respect to the housing 12 during operation of the energy generator 10.

The material, size and shape of the housing 12, including whether or not the housing 12 includes an opening 20 or a covering member 23, as well as the positioning of the broad-band signal generator 30 with respect to the chamber 14 (including the proximity of the broad-band signal generator 30 to the walls 13 and front opening 20), influences and effects the operation and emissions of the broad-band signal generator 30 and the energy generator 10. It has been found that the emissions generated by the broad-band signal generator 30 in the housing 12, and the formation and field strength of a plasma or highly ionized gas 27 developed within the housing 12, will depend upon a number of factors including the material of the housing, whether or not the opening 20 of the housing is covered, the material and thickness of the covering member 23, whether or not the housing is hermetically sealed, the power output of the broad band signal generator 30, the dimensions of the housing, and the distances that the housing walls 13 are from the broad-band signal generator. In one embodiment, the broad-band signal generator 30 preferably is positioned with respect to the chamber 14, and in proximity to walls 13 of the housing 12, to create plasma or highly ionized gas 27. That is, the placement and positioning of the broad band signal generator 30 with respect to the housing 12, and preferably its position at least partially within the housing 12, will effect, influence and facilitate the creation of a plasma 27 in the housing 12.

Housing 12 is preferably formed of steel although other materials including metals, metal alloys, plastics, polymers, composites, ceramics, insulators, dielectric materials, and combinations and coatings of these materials are contemplated. The chamber 14 preferably has a rear portion 11 and a front portion 21. Front portion 21 preferably forms a throat or ejection port 21*a*, and has an opening 20. The housing 12 may include brackets and supports 24 for mounting the housing 12 to a support plate 25, such as, for example a torsion plate.

Figure 7:
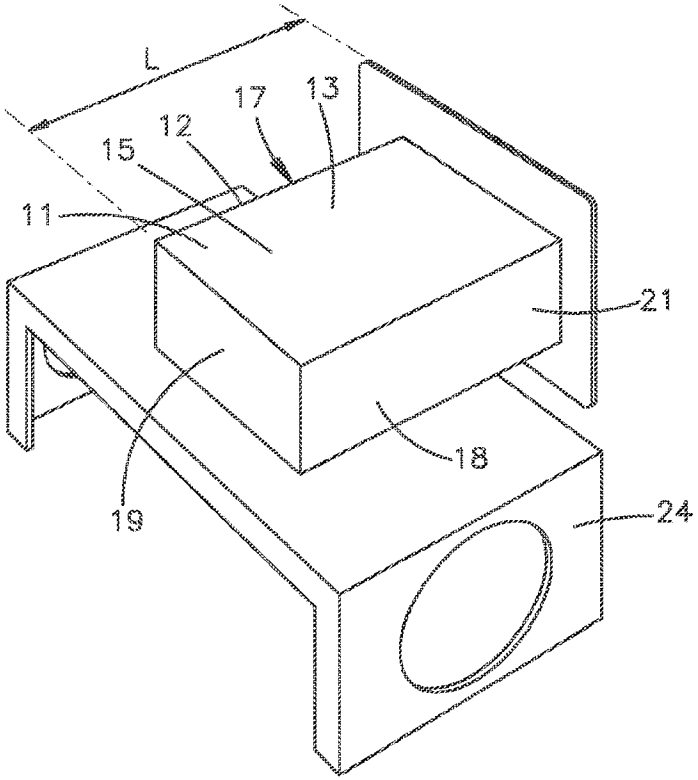
FIG. 7 is a top perspective view of the housing of FIG. 6.
Figure 6:
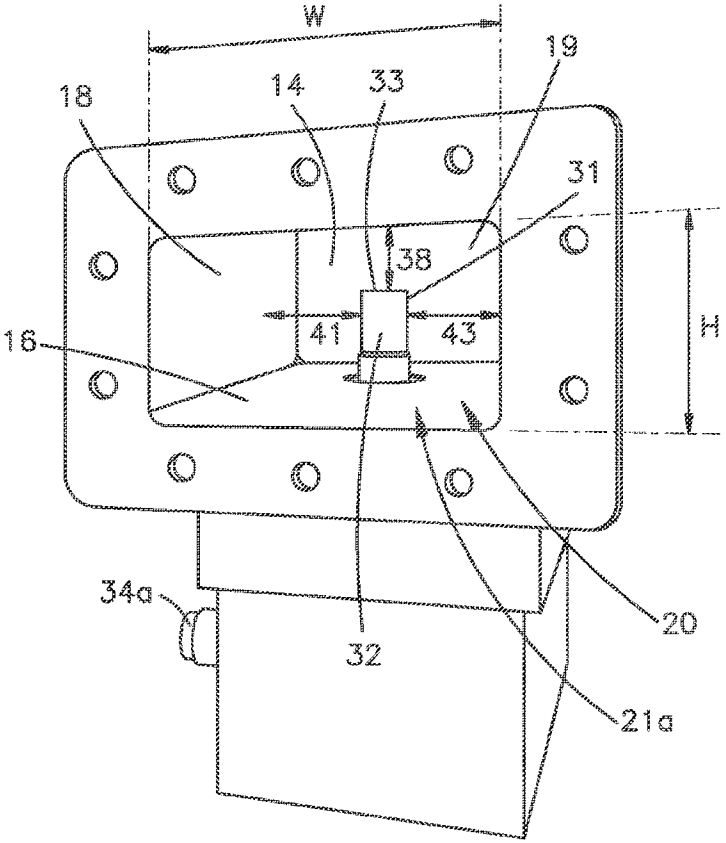
FIG. 6 is a side perspective view of one exemplary embodiment of a housing with the broad-band signal generator of FIGS. 3 and 4 mounted thereto.

Housing 12 has one or more walls 13 defining the interior cavity or chamber 14. The housing may completely enclose or surround the cavity 14, or may have one or more openings 20. The housing 12 in one embodiment, shown in FIGS. 6 and 7, is preferably generally parallelepiped in shape. The housing may form other shapes, such as, for example, a sphere, a prism, a cube, and other multi-sided three-dimensional shapes. The steel walls 13 of housing 12 in one embodiment have a thickness (t) of about 118 of an inch to about 112 and inch, preferably about ¼ of an inch. The thickness (t) of walls 13 described above are only representative examples and the thickness (t) is not limited to the range disclosed. The thickness (t) of the housing walls 13 may be larger or smaller than the values described above, depending upon the desired result.

The inside cavity 14 of housing 12 of FIGS. 6 and 7 has five walls 13, including a top wall 15, a bottom wall 16, aright side wall 17, a left side wall 18, and a back wall 19. Positioned opposite back wall 19 and in the front portion 21 of the housing 12 preferably is an opening 20. The top wall 15, bottom wall 16, two side walls 17 and 18, and the back wall 19 preferably are formed and bent from a single piece of material and preferably are connected in a manner to hermetically seal the seams along the side edges. In one exemplary embodiment, the walls 13 are welded together at the adjoining seams, although other methods of forming housing 12 and connecting, preferably sealing, walls 13 are contemplated. In alternative embodiments, housing 12 may include a front wall 23*a* that is integrally and monolithically formed of the same material as at least one other wall 13, and front wall 23*a* may be bent to cover and preferably hermetically seal opening 20. In this embodiment, where the front wall 23*a* is formed of the same material as at one of the other walls 13 and possibly all of the other walls 13, the housing 12 may completely surround and enclose the chamber 14.

It has been found that covering and/or sealing the opening 20 of housing 12 (enclosing the cavity 14) influences and has an effect on the operation of the broad-band signal generator and its emissions, and specifically the magnetron emitter 31. It has been found that hermetically sealing the housing 12, including covering optional opening 20 if it exists, influences, effects and facilitates the creation or formation of plasma 27 and the generation of electromagnetic waveforms including radio frequency waves, microwaves, acoustic waves and/or photons, as well as the generation of subatomic and/or charge-less or substantially charge-less particles and a charge-less magnetic wave. Depending upon the desired result, the opening 20 of the housing 12 may be partially or fully covered and/or sealed with one or more covering members 23. Covering member 23, may be in the form of a separate plate 23*b* attached to housing 12 that covers opening 20, or covering member 23 may be an additional wall 23*a* formed as part of housing 12. Depending upon the desired result, the energy generator 10 may not have a covering member 23 and the housing opening 20 may remain open.

The type of material covering opening 20 also will influence and effect the formation of the plasma 27, the emissions 5 created by the broad band signal generator 30, the emissions generated in the housing 12 and/or the emissions 3 emitted from the energy generator 10. More specifically, the type of material out of which covering member 23 is formed or coated, will affect whether or not, and the amount of electromagnetic waveforms that are reflected, deflected, redirected, refracted, or transmitted by the covering member 23. In this regard, different materials with different reflective, refractive and transmissivity properties have different affects on the emissions generated in and emitted out of the housing 12. It is believed that the electromagnetic waves created by the broad-band signal generator 30 reflect and deflect off the steel housing walls, and it is further believed that the covering member 23, depending upon its material and thickness, will at least partially reflect, deflect, and redirect the radio frequency waves, microwaves, acoustic waves and/or photons back toward the broad-band signal generator 30. Reflecting, redirecting and deflecting the energy, electromagnetic wave forms, acoustic waves, photons and charged particles formed by the broad-band signal generator 30 back toward the broad-band signal generator 30 is believed to increase the number and severity of collisions of the charged particles in the electromagnetic waves. It is believed that these collisions of atomic charged particles facilitate the creation of the plasma 27 (including ions and free radicals), the plasma field 27*a*, the subatomic particles and/or charge-less particles and/or charge-less magnetic wave having substantially no electric field. At least partially deflecting the energy of the electromagnetic waves, photons and acoustic waves back into the plasma 27 is believed to cause the electromagnetic waveforms to collapse, and is believed to increase the frequency, severity and energy of the collisions of the charged particles in the electromagnetic wave forms creating charge-less or substantially charge-less particles and/or subatomic particles and/or charge-less magnetic wave having no or substantially no electric field.

The type of material and thickness of covering member 23 influences and effects the plasma 27 and the plasma field 27*a* in the housing 12, and the emissions 5 of the energy generator 10. For example, while the use of a dielectric material, such as a polycarbonate sheet or plate 23*b*, for covering member 23 may partially reflect, redirect and deflect the radio frequency waves, microwaves, and/or photons, the dielectric covering sheet 23*b* may also permit radio frequency waves, microwaves, acoustic waves and/or photons, in addition to any subatomic or charge-less particles and magnetic waves having substantially no electric field, to be refracted and/or transmitted through the dielectric covering member 23. Thus, the type of material covering (completely or partially) the opening 20 in the housing 12 affects the amount of energy and the type of electromagnetic wave forms reflected, deflected and/or redirected back toward the broad-band signal generator 30 and affects the formation of the plasma 27, the density of the plasma 27, the strength of the plasma field 27*a*, and the generation of subatomic and/or charge-less or substantially charge-less particles and/or charge-less magnetic wave having no or substantially no electric field. The thickness of the dielectric material forming the covering member 23 and its reflective, refractive, and transmissivity characteristics also influences and effects the emissions 3 out of housing 12 and from the energy generator 10.

In yet a different embodiment, optional covering member 23 may be formed of or coated with a metal, such as, for example, lead, steel, aluminum, gold, silver, platinum, rhodium, ruthenium, palladium, osmium, iridium, copper, nickel, noble metals or other metals, metal alloys, or a combination of metals. Several different metals or coatings may be used for covering member 23. The use of a metal or metal coated material covering opening 20 will affect the emissions 5 produced in the housing 12 and emitted from the energy generator 10. It is believed that the use of a metal or a member coated with metal will reflect and redirect substantial amounts of the radio frequency waves, microwaves, acoustic waves and/or photons back toward the broad-band signal generator 30 and plasma 27. It is believed that increasing the amount of energy, for example in the form of electromagnetic waves, radio frequency waves, microwaves, acoustic waves and photons will increase the number of collisions of energized particles and ions in the plasma and in the chamber to increase the production of substantially charge-less particles. For example, with a lead plate 23*b* of sufficient thickness (t) covering opening 20, no radio frequency waves, microwaves and/or photons are emitted from energy generator 10, however, a magnetic wave with no or substantially no electric field current is emitted including subatomic and/or charge-less particles.

In the embodiment where a metal covering member 23, such as lead plate 23*b*, is used, the plasma 27 and plasma field 27*a* may be stronger than the plasma 27, and plasma field 27*a* created when a dielectric plate 23*b* is used. It is believed that a metal or metal coated covering member 23 will reflect, deflect and redirect more of the energy, e.g., more of the radio frequency waves, microwaves, acoustic waves and/or photons produced by the broad-band signal generator back toward the broad-band signal generator 30, than a dielectric or other covering member which is more transmissive to the radio-frequency waves and photons present in the housing 12. A metal or metal coated covering member 23 typically results in a more dense plasma 27 having a stronger plasma field 27*a*, which may cause more collisions and generate more subatomic charge-less particles and a stronger magnetic wave propagation of charge-less particles. Likewise, if a dielectric covering member 23 is used it may create a more dense plasma, a stronger plasma field and more charge-less particles than when housing opening 20 is left unrestricted, uncovered and/or unsealed, or where a more transmissive covering material is used.

Covering member 23 may be formed of or coated with metal or metal alloys as described above, and/or formed of or coated with plastics, polymers, polycarbonates, ABS plastics, polyamides, polyethylenes, polypropylenes, glass, leaded glass, silicon, ceramics, minerals (e.g., quartz), composites or other materials or combination of materials. In one embodiment, the covering member 23 is a steel wall monothically formed as part of housing 12, preferably bent to form front wall 23*a* to cover opening 20, and preferably the same thickness as housing walls 13. In other embodiments, the covering member 23 may be front wall 23*a*, which may be thinner or thicker than the housing walls 13. In yet other embodiments, covering member 23 may be one or more separate plates 23*b* formed of or coated with one or more materials and attached to the housing 12, preferably hermetically sealing the opening 20.

In one exemplary embodiment, covering member 23 may include a "particle charge" suppression plate formed of lead having a thickness of 114 to ½ inches and dimensions sufficient to completely cover and seal the opening 20 of the housing 12. Such a covering member 23 has been shown to be sufficient when used with magnetron emitters 30 of 600 watts to 1250 watts so that only particles that do not carry any substantial electrical charge (e.g., substantially charge-less particles) exit through the throat 21*a* of housing 12 through covering member 23. When a covering material of appropriate material and sufficient thickness is selected, all electromagnetic waves and electric fields are prevented from leaving the reactor and a pure "magnetic field" having an "electric field" of substantially zero is emitted from the energy generator 10.

Referring to FIG. 1, covering member 23 may also include an aluminum plate 23*c* with dimensions sufficient to completely cover the opening 20 of housing 12. The aluminum plate may overlap and layover the lead plate 23*b* and be configured so that the lead plate 23*b* faces the interior of the housing chamber 14 while the aluminum plate is exterior to the housing 12. A thickness of 118 to 114 inch is sufficient for the aluminum plate to contain any fugitive microwave and radio-frequency emissions that may pass through the lead plate 23*b*. In other embodiments, it may be desirable to use the aluminum plate without the lead plate, or with a different plate or coated plate. In still further embodiments, it may be desirable to replace aluminum plate 23*c* in FIG. 1 with a material other than aluminum. For example, when plate 23*c* is comprised of copper or platinum as well as compositions of other noble metals it is possible to cause gamma radiation to emit from the energy generator 10.

Figure 10:
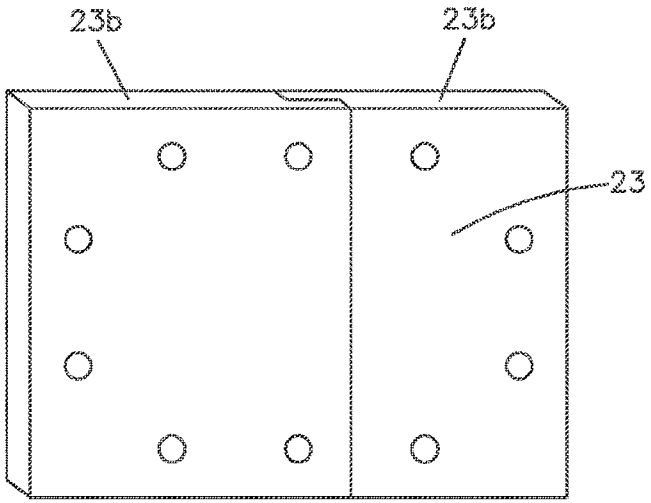
FIG. 10 is a diagrammatic illustration of a different embodiment of a covering member for an opening in the housing of FIGS. 7 and 8.
Figure 9:
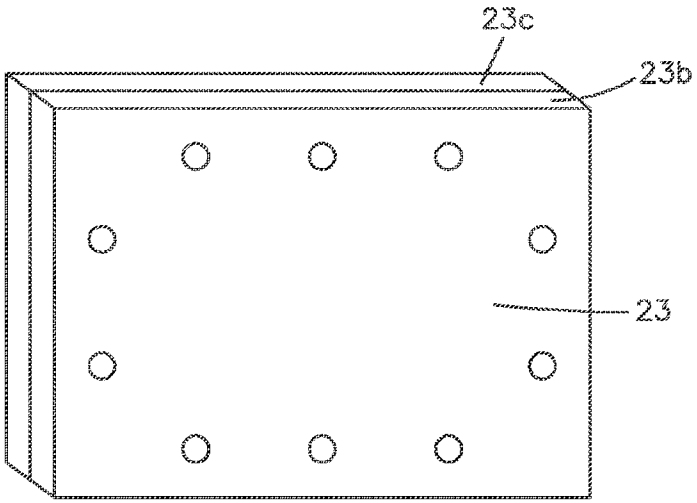
FIG. 9 is a diagrammatic illustration of one embodiment of a covering member for an opening in the housing of FIGS. 7 and 8.

A combination of dielectric covering members 23 and metal covering members 23 is also contemplated where the different materials may be overlapping sheets similar to a laminated sandwich as shown in FIG. 9, or side by side plates that abut or overlap at the ends as shown in FIG. 10. In one exemplary, representative embodiment, the covering member 23 covering and sealing opening 20 in the housing 12 includes the material DELRIN manufactured by DuPont having a thickness of about ¼ of an inch to about ⅜ of an inch, more preferably about 114 of an inch. The DELRIN sheet may be used alone or in combination with other materials, coatings and plates such as ABS plastic, glass, quartz or other materials.

As stated above, the power output of the broad-band signal generator, the positioning of the broad-band signal generator within the chamber 14, and the distance of the source or emitter of the broad-band frequency, including the radio waves, microwaves, acoustic waves, and/or photons, to the housing walls 13 and front opening 20, influences and effects the operation and emissions of the broad-band signal generator 30, the emissions and energy forms within the housing 12, and the emissions and output of the energy generator 10. Preferably, the broad-band signal generator 30 is operatively associated with, positioned in proximity to and/or positioned within the chamber 14 and in proximity to the housing walls 13 to produce or emit radio waves, microwaves, acoustic waves, and/or photons within the housing 12, more preferably to create a plasma 27. By way of example, properly positioning the emitter or source of the broad-band signal generator 30 within an appropriately dimensioned and designed chamber 14, in appropriate proximity to the walls 13 of the housing 12, will influence and facilitate the creation of a plasma 27 within the housing 12.

Figure 8:
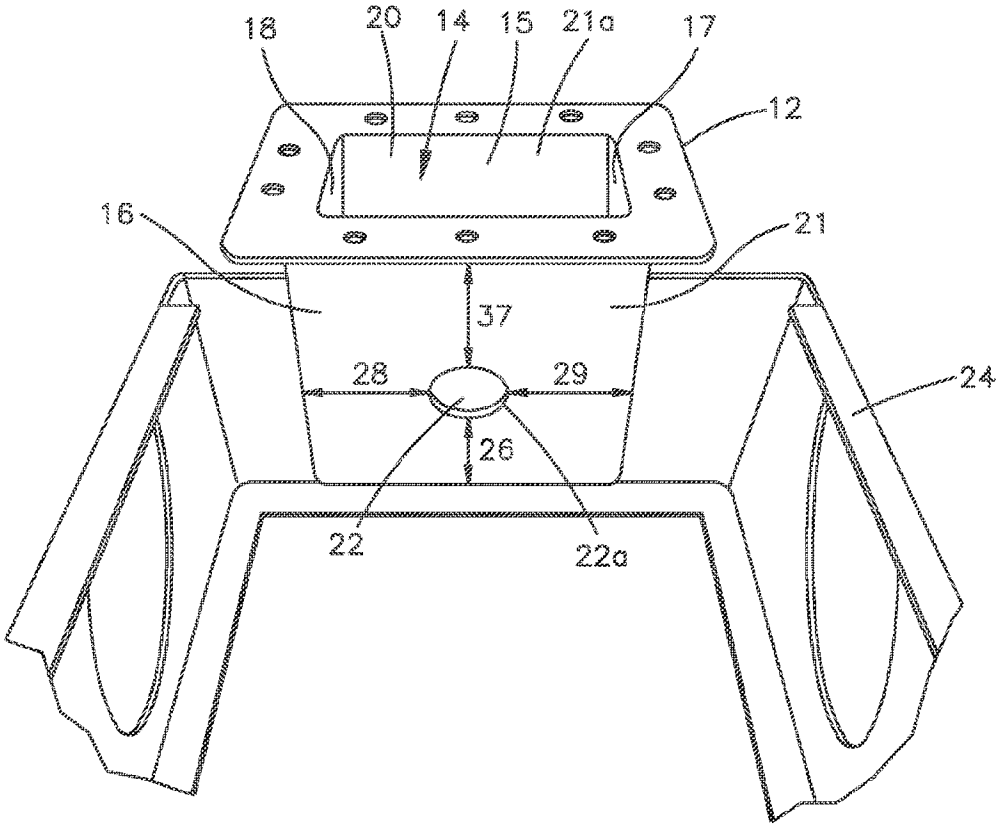
FIG. 8 is a bottom perspective view of the housing of FIG. 7.

In one exemplary embodiment, a known microwave magnetron emitter 31 that under normal operating conditions generates microwaves of about 2.4 GHz may be positioned and mounted to the housing 12. Normal operating conditions would include at and about room temperature, at and about atmospheric pressure and supplied with approximately 120 volts of sinusoidal alternating-current. The magnetron emitter 31 is preferably mounted to housing 12 as shown in FIG. 6 such that the cathode or emitter 32 of the magnetron emitter 31 extends into the interior of the reaction chamber 14. A hole 22 is provided in bottom wall 16 of housing 12, as shown in FIG. 8, to permit the cathode 32 of the magnetron emitter 31 to extend into the interior of chamber 14 as shown in FIG. 6. Hole 22 may be about 12 mm to about 16 mm in diameter and may vary in shape and size depending upon the size and shape of the cathode 32, and the desired position of the cathode 32 within the housing 12. The hole 22 preferably is sized to be as small as possible to permit the cathode 32 to pass into the reactor chamber 14. The magnetron emitter 31 is preferably attached to the housing 12 in a manner to hermetically seal the housing 12 with cathode 32 protruding into the interior cavity 14 of the housing 12.

Magnetron emitters 30 having a power output ranging from about 600 watts, to about 75 KW have been used. Other power output levels less than and more than the range used above are contemplated for the magnetron emitter 31 depending upon the desired result, and it is believed that the power output of the magnetron emitter 31 is scalable in the housing 12 and energy generator 10, as demonstrated by the range of magnetrons already used and as explained further below. If desirable, a variable power microwave magnetron emitter 31 is also contemplated for use with the generator 10.

In one embodiment, for use with a broad-band signal generator 30, more preferably a microwave magnetron emitter 31 having a power output from about 200 watts to about 2 KW, and more preferably a power output of about 600 watts to about 1.2 KW, housing 12, as shown in FIG. 6, has a width (W) of about 85 mm to about 115 mm, and preferably about 100 mm; a height (H) of about 85 mm to about 95 mm, and preferably about 90 mm; and a length (L) of about 100 mm to about 140 mm, preferably about 122 mm. In other embodiments with a more powerful magnetron emitter 31, the housing dimensions may be enlarged to facilitate and influence the creation and density of the plasma 27. The width (W), height (H) and length (L) dimensions for the housing 12 generally will change depending upon the power of the magnetron 31 and the dimensions are roughly scalable such that as the power of the magnetron is doubled the housing dimensions will approximately double, or increase by a factor of about 2.0 to about 2.2. Note these dimensions are only exemplary and the magnetron emitter 31, housing 12, energy generator 10 and invention should not be limited to the specified dimensions and power ranges unless set forth in the claims.

Depending upon the desired result and the power output of the magnetron emitter 31, the distance 26 (shown in FIGS. 6-9) that the boundary (outer periphery) 22*a* of the hole 22 is from the back wall 19 may change. In the embodiment of FIGS. 6-8, the emitter hole 22 is centered in the width (W) direction of bottom wall 16 of the housing 12. The distance 28, 29 that the emitter hole boundary 22*a* is from side walls 17, 18 may vary depending upon the power of the magnetron emitter 31 and the desired results. In the embodiment of FIGS. 6-8, the emitter hole 22 is centered in the bottom wall 16 in the width direction (W), but not in the length direction (L), where the distance 37 from the hole boundary 22*a* to the opening 20 is preferably greater than the distance 26 from the hole boundary 22*a* to the back wall 19. Distance 37 may change depending upon the power output of the magnetron emitter and the desired results.

While in the embodiment of FIGS. 6-8, the emitter hole 22 is centered in the bottom wall 16 in the width direction (W), the hole 22 also may be positioned off-center in the bottom wall 16 in the width direction (W) so that distances 28 and 29 are different from each other. Depending upon the results desired, the distance 26 to the back wall 19 is generally less than the distances 28, 29 to the side walls 17, 18, and less than the distance 37 to the front opening 20 for reasons explained below.

Figure 2:
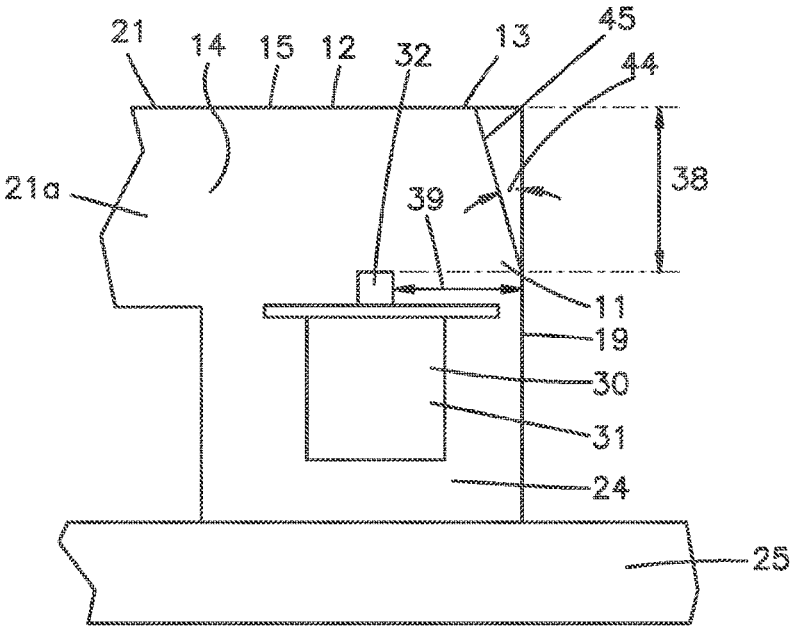
FIG. 2 is a cross-sectional schematic representation of a rear portion of the housing of the energy generator of FIG. 1.

In one embodiment, the magnetron emitter 31 preferably is positioned so that the cathode 32 of the emitter 31 is oriented at or about 90° (at or about at a right angle) with respect to the bottom wall 16 of the housing 12 as shown in FIG. 6. The fixed position of emitter 31 and the orientation of cathode 32 are shown, for example in FIGS. 1, 2 and 6. Spacing dimension 38 in FIGS. 2 and 6 represents the air gap spacing 38 along the Z-axis between the top surface 33 of cathode 32 and the interior top wall 15 of reactor housing 12. Spacing dimension 39, in FIG. 2 along the X-axis or the length direction (L), between the cathode 32 and the interior back wall 19 of the housing 12 represents the bleed-off spacing gap 39'. Spacing dimension 41 and 43 in the Y-axis or width direction (W), between the outer side wall 33*a* of the cathode 32 and the interior side walls 17, 18 of the housing 12, may also represent the bleed-off spacing gap, depending upon the relative values of spacing dimensions 39, 41 and 43. The bleed off spacing gap 39' will generally be the smallest distance between the cathode and a potential grounding wall or grounding element of the housing 12. Where the distance between the cathode 32 and one or more walls 13 is the same or substantially the same (and closer to the cathode 32 than other potential grounding walls 13), then that distance will be the bleed-off spacing gap 39' and each of those walls will affect the partial quenching of the plasma. In other words, the bleed-off spacing gap 39' generally will be the shortest distance from the cathode emitter 32 to a potential ground.

In the embodiments of FIGS. 6-8, since the emitter hole 22 is similar to but slightly larger than the diameter of the cathode 32, spacing dimension 26 is similar to and preferably slightly smaller than spacing dimension 39, while spacing dimensions 28, 29 are similar to and preferably slightly smaller than spacing dimensions 41, 43.

Dimension 38, and dimensions 39, 41 and 43, of the cathode 32 relative to the housing walls 13 will likely change depending upon the output power of the broad-band signal generator 30 and the desired result (e.g., whether the creation of a plasma is desired). Dimension 38 (the distance to the top wall 15) preferably is adjusted sufficiently to cause a compression of the electromagnetic field to influence, facilitate, permit and/or result in the formation of the plasma 27 above and around the cathode 32 without causing an ARC fault (complete short) between cathode 32 and housing 12. If dimension 38 is excessively large, then the arrangement provides sufficient insulation such that the plasma 27 generally will not form. Conversely, if the dimension 38 is excessively small, then the dielectric properties are sufficiently "low", creating an ARC or spark between cathode 32 and housing 12, which acts as a ground potential for the cathode 32. If this grounding condition occurs, where the cathode arcs or sparks to the housing, plasma 27 generally will not form.

Just as spacing dimension 38 influences the formation of the plasma 27 without creating an ARC fault, e.g., a discharge or spark to the top interior wall surface of the housing 12, spacing dimension 39 from the outer surface 33*a* of the cathode 32 to the interior back wall 19, and spacing dimension 41 and 43 from the outer surface 33*a* of the cathode 32 to the interior side walls 17, 18 of the housing 12, influences, facilitates, permits and/or results in the plasma 27 forming and expanding to near ARC fault conditions without providing a path to ground. With the cathode 32 properly positioned in an appropriately dimensioned housing 12, the plasma will form in the Z direction above the top surface 33 of the cathode 32 and the top wall 15. The plasma is then believed to expand in the X-Y plane in the housing 12 until the plasma 27 is "bleed off" which provides a partial quenching of the plasmatic field 27*a*. The partial quenching of the plasma field 27*a* contracts the plasma 27 and plasma field 27*a*. After the plasma 27 and plasma field 27*a* is reduced and contracts as a result of bleed off to ground, the plasma 27 and plasma field 27*a* again start to expand. The spacing dimensions 39, 41 and 43 influence, affect, facilitate, permit and/or cause the partial quenching or bleed-off of the plasma. Specifically, as the plasma expands it comes into proximity to a ground, which in this case may be one of the housing walls 13, and in housing 12 depending upon the dimensions and positioning of the cathode 32 may be side walls 17, 18 or back wall 19. The plasma 27 and plasma field 27*a* will bleed off and quench to the closest ground source, and the distance from the outer surface 33*a* of the cathode to the ground source will be referred to as the bleed-off gap. This expansion and contraction effect, or oscillating of the plasma 27, is affected and/or caused by the dimensions of the housing 12, the spacing dimensions 38, 39, 41 and 43 of the cathode relative to the housing walls, the power output of the magnetron emitter 31, and the material, or lack of material covering (partially or completely) and/or sealing the opening 20 in the housing 12.

Typically, but not necessarily, the bleed-off spacing gap 39' is smaller than the air gap spacing 38. It should be noted that the expansion and contraction of the plasmatic field 27*a* is different than a pulsed signal from magnetron emitter 31. The oscillating of the plasma 27 in generator 10, e.g., the expansion and contraction of the plasma field 27*a*, preferably results from supplying the magnetron with power so that the plasma 27 forms and expands until some of the plasma is bleed off or partially quenched as a result of the partial ground which contracts the plasma. During this preferred oscillating of the plasma, power is continually fed to the magnetron emitter 31 and yet the plasma field 27*a* and the plasma 27 expand and contract or oscillate. Other means of creating an oscillating plasma 27 are contemplated such as for example by pulsing the power level to the magnetron emitter 31 and even pulsing the power to the magnetron emitter 31 on and off.

A representative example of energy generator 10 having a 600 watt magnetron emitter 31 that creates a plasma 27 has the cathode emitter 32 positioned in housing 12 of FIGS. 6-8 so that dimension 38, the air gap spacing above the cathode 32, is about 15 mm, while the dimension 39 between the cathode 32 and back wall 19, in this example the bleed-off spacing gap 39', is about 12 mm. The dimensions 41 and 43 between the cathode 32 and the side walls 17 and 18, respectively, of the housing 12 were sufficiently larger than dimension 39 from the cathode 32 to the back wall 19, such that the side walls 17, 18 did not provide or substantially affect the partial quenching of the plasma field 27*a*. In the embodiment of FIGS. 6-8, where energy generator 10 uses a 600 watt magnetron emitter, the dimensions 41 and 43 of housing were about 15 mm, or roughly the same as the air gap spacing 38. Likewise, the distance 37 to the front opening 20, and particularly to the optional covering member 23 for the opening 20, is sufficiently larger than the air gap spacing 38 or the bleed off spacing 39' so as not to substantially affect the quenching of the plasma 27.

In a further example, an energy generator 10 having a magnetron emitter 31 that is supplied with power that varies from about 250 watts to about 1250 watts and which created a plasma 27 had the cathode emitter 32 positioned in housing 12 of FIGS. 6-8 so that dimension 38, the air gap spacing above the cathode 32, and dimensions 41 and 43 from the cathode to the side walls were the same and each was about 40 mm to about 45 mm, preferably about 43.2 mm, while the dimension 39 from the outer surface 33*a* of the cathode 32 to the back wall 16 was about 25 mm to about 30 mm, preferably about 28 mm; and the dimension 37 from the outer surface 33*a* of the cathode to the opening 20 or optional covering member 23 was about 75 mm to about 80 mm, more preferably about 78 mm. These dimensions are some exemplary, representative dimensions for the spacing between the cathode 32 and the housing walls 13 for energy generator 10 that preferably should produce a plasma 27 and plasma field 27*a*, preferably an oscillating plasma 27 and plasma field 27*a*, which generate electromagnetic waveforms (including radio frequency waves, microwaves, acoustic waves and/or photon waves) as well as subatomic particles, charge-less or substantially charge-less particles, and a charge-less magnetic wave (magnetic wave with no or substantially no electric field).

Other embodiments of the generator 10 using magnetron emitters 30 having power outputs of about 2 KW to about 75 KW have been used. Dimensions 38, 39, 41 and 43 were adjusted accordingly for each housing 12 in proportion to the increase in power output of the magnetron emitter 31. For example, in another embodiment of the generator 10 using a 75 KW magnetron emitter 32, the air gap spacing dimension 38 between the top surface 33 of cathode 32 and top interior wall 15 of housing 12 was about 25 cm, while the spacing dimension 39 between the outer surface 33*a* of the cathode 32 and the back wall 19 was about 20 cm. Spacing dimensions 41 and 43 were both about 25 cm, and the spacing dimension 37 from the cathode 32 to the front covering member 23 was about 45 cm.

Preferably, in one embodiment, covering member 23 seals the opening 20. Referring to FIGS. 1, 2 and 6-8, with dimensions 38, 39, 41 and 43 sufficiently adjusted, plasma 27 typically will form within the internal cavity 14 of the housing 12 between the top surface 33 of cathode 32 and the top wall 15 in the housing 12, where the housing 12 preferably is filled with air, is hermetically sealed and is at a standard atmospheric pressure before operation of the broad band signal generator 30. As the broad-band signal generator 30 is operated it is believed that the internal pressure increases within the housing and, there is a proportional increase in the plasmatic field 27*a*.

By sealing the opening 20, and creating a hermetically sealed housing 12, the expansion and contraction of the plasma 27 and the plasmatic field 27*a*, i.e., the oscillating of the plasma, builds very high acoustical pressures. These acoustic pressures apply very high order of magnitude forces on the contained plasma 27. In one embodiment, the housing 12 is hermetically sealed at about 1 atmosphere of pressure. The housing 12 may also be sealed at lower or higher pressures depending upon the desired result. The housing is filled with air but other mediums are contemplated, such as, for example, Helium, Argon, or Nitrogen gas, and may include liquids and other forms of matter, and the housing may be sealed so that the cavity in the housing is under vacuum conditions.

As stated above, the shape of the housing 12 also influences and effects the emissions 5 created within the housing 12 and the emissions 3 emitted from the energy generator 10. In this regard, the rear portion 11 of the housing 12 optionally may include a chamfer plate 45, and/or the back wall 19 of the housing 12 may have an angle 44 with respect to the top wall 15 and/or bottom wall 16 so that the back wall is non-perpendicular. In this manner the back wall 19 may be non-perpendicular with respect to the longitudinal axis of the cathode 32. In one embodiment, the back wall 19 may be angled about 1.5 degrees to about 2 degrees from perpendicular with the top wall 15. The back wall 19 may be oriented at any other angle and angled to any desirable degree, including, for example, about ten (10) degrees or more, and including about 45 degrees (from a perpendicular orientation) depending upon the desired result. Optionally, chamfer plate 45 may be included in the rear portion 11 of the housing 12 between the back wall 19 and the top wall 15 as shown in FIG. 2. Chamfer plate 45 is preferably metal, and preferably the same material as the housing walls 13.

The optional inclusion of chamfer plate 45 and/or the angulation of the back wall 19 is believed to reflect and deflect the electromagnetic wave forms produced by the broad band signal generator 30 to scatter the electromagnetic waves and have them reflect and deflect off other walls 13 within the housing 12. The addition of the chamfer plate 45 and/or the angulation of the back wall is believed to create a more dense plasma 27 and stronger plasma field 27*a*. That is, the electromagnetic wave which may include the charge-less or substantially charge-less particles, subatomic particles, radio frequency waves, microwaves, acoustic waves and photons, is believed to bounce off the back wall 19 and then is preferably reflected angularly around the chamber housing 12 in part because of the angled back wall 19 or chamfer plate 45. Referring to FIG. 2, an optional chamfer plate 45 is installed at the rear of reactor housing 12, preferably in the space above the top of the cathode 32 and preferably positioned at about a 45° angle. In one embodiment optional chamfer plate 45 may be movable so that the angle 44 that the chamfer plate 45 makes with the back wall 19 may be changed to optimize the emissions from the energy generator 10. Optionally, the chamfer plate 45 may be moveable so that it can flutter back and forth, changing its position in the reactor and optionally its angle 44 with the back wall 19. Such fluttering of the chamfer plate 45 may facilitate the quenching of the plasma field 27*a* as the bleed-off distance 39' between the cathode 32 and a potential ground or grounding wall changes as the chamfer plate 45 changes its distance and proximity to the cathode 32.

In operation, the charge-less particles and magnetic wave may need a means and mechanism to move, propagate and launch from the reactor 14. That is, the charge-less particles may need an engine to move and direct them. The broad band signal generator 30 creates electromagnetic wave forms that may include sound pressure waves. These acoustic pressures propagate in the X-axis as referenced in FIG. 1 and may be combined with alternating compression effects caused by the chamfer plate 45 and/or the angulation of the back wall 19. These acoustic pressures may be one means of moving the charge-less particles through space. The compression and expansion of the plasma (oscillating plasma) also builds very high acoustic pressures within the reactor 14. These acoustic pressures apply very high order forces on the contained plasma 27. The high acoustic pressures couple with the plasma, and the pressure waves are believed to provide the electro-motive force to move, accelerate and propagate the charge-less particles out of the housing 12. In this manner, it is believed that the creation of the electromagnetic wave forms including the acoustic pressure waves is the engine which moves the charge-less particles and launches the charge-less particles out of the housing 12. It is believed that the length of the throat 21*a* of the housing may improve the acceleration and velocity of the propagating magnetic wave of no or substantially no electric field current which preferably contains charge-less or substantially charge-less particles and effects the distance that the charge-less particles are emitted from the energy generator 10.

The resulting reactions in the housing may emit excessive heat which may ultimately effect the longevity of the plasma 27. Excessive heat generation is stabilized and controlled by the installation of one or more optional cooling devices 50. Optional cooling devices 50 may include many different mechanisms and systems including a heat sink, a fan 51, a duel fan "peltier" thermal mass transfer device 52, a heat exchanger, liquid cooling systems, or a combination of these devices. Other heat exchangers and cooling devices for use with energy generator 10 are contemplated.

Figure 11:
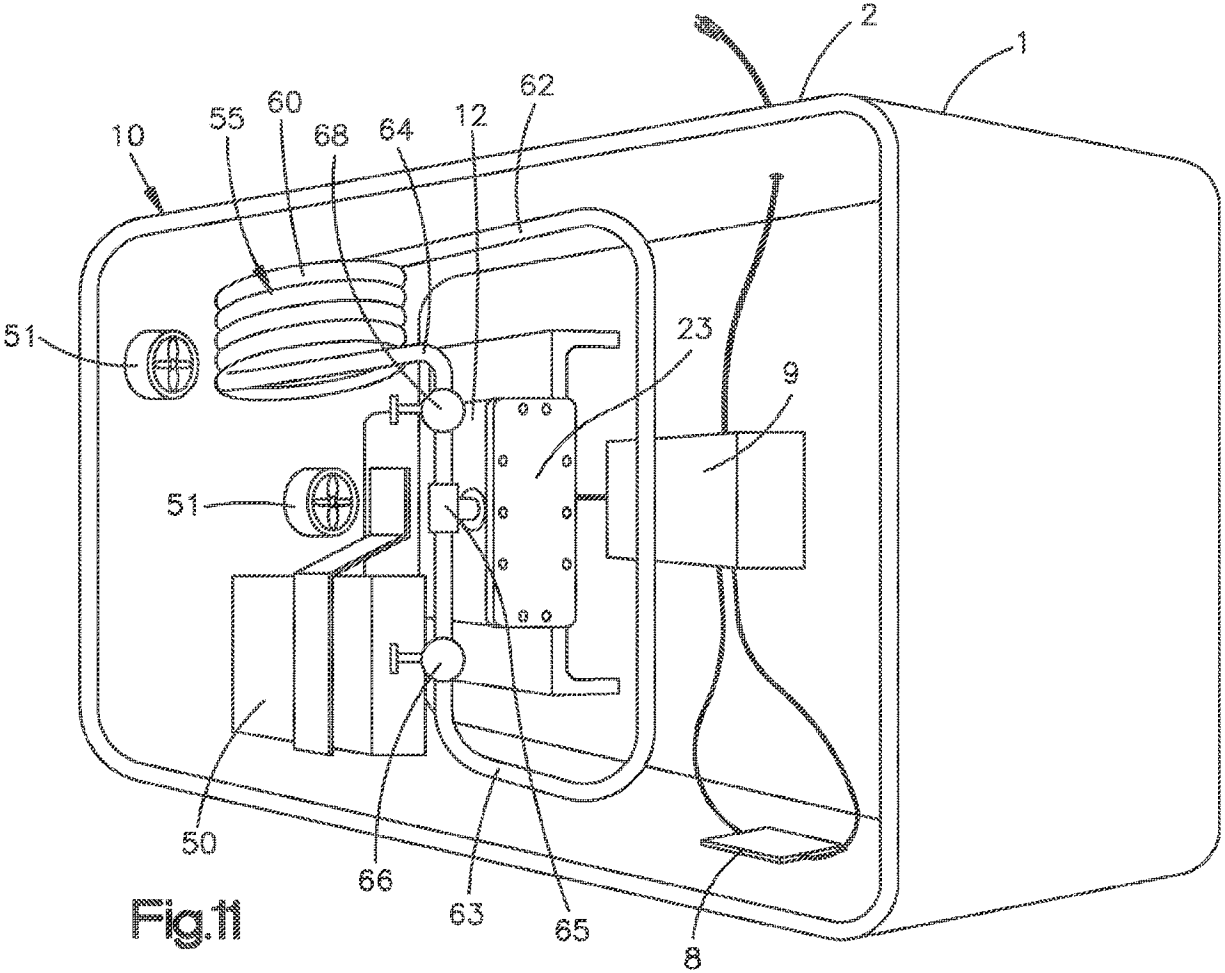
FIG. 11 is a top side perspective view of one embodiment of an energy generator of the present invention.
Figure 12:
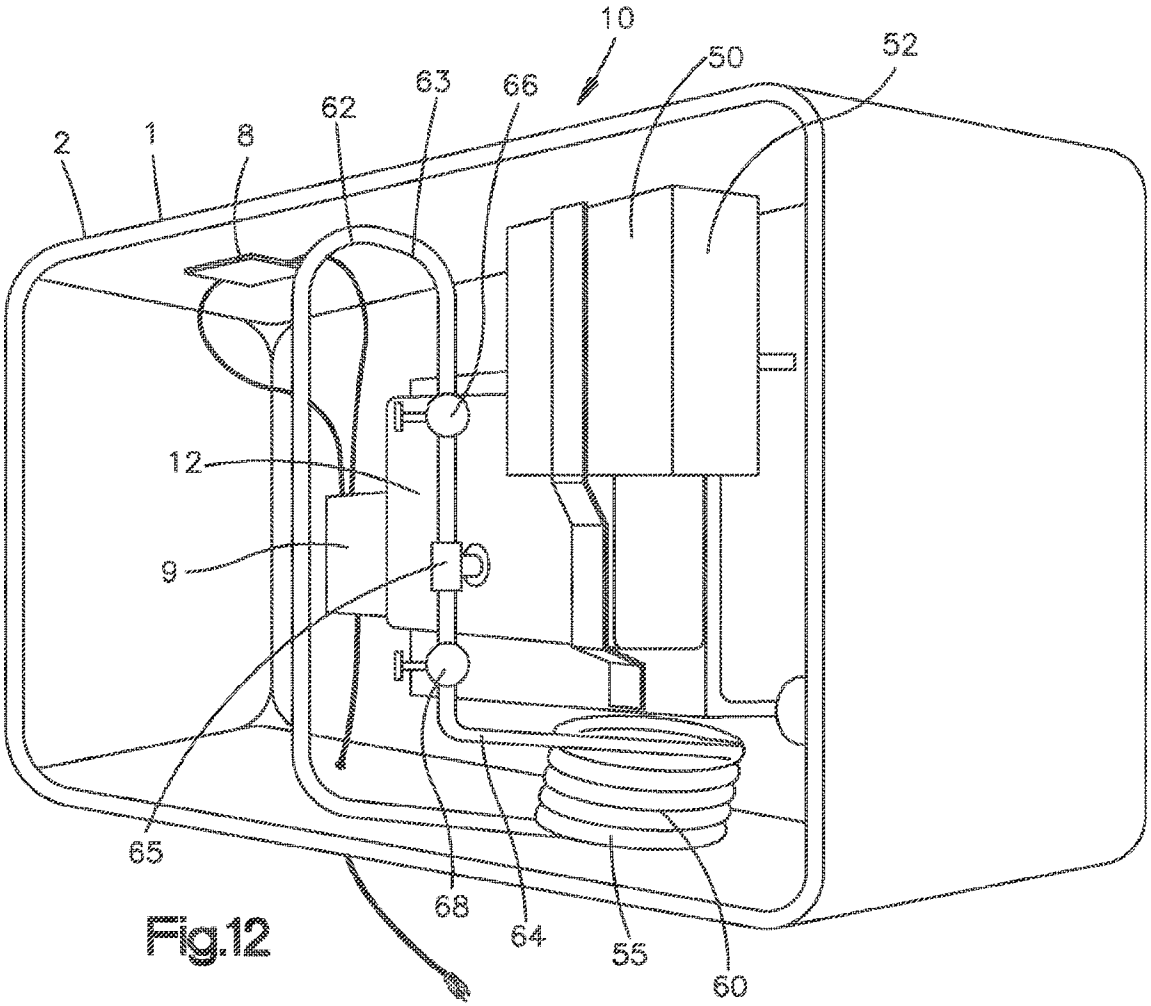
FIG. 12 is a top side perspective view of the energy generator of FIG. 11.

Optionally, the energy generator 10 may be provided in a casing 2 as shown in FIGS. 11 and 12. Casing 2 may include a bottom 1 and a top (not shown) that contains the various components for the energy generator 10 including, for example, the power supply components 9, an operating (on-oft) switch 8, housing 12, signal generator 30 and optional cooling devices 50. Note that in FIGS. 11 and 12 a number of the power supply components 9 and electrical connections, for example to the cooling devices and signal generator, have been eliminated for purposes of clarity. Casing 2 may be configured and made of a number of different materials including plastics, composites, metals, ceramics, wood or other materials.

In addition, as shown in FIGS. 11 and 12 and schematically illustrated in FIG. 1, energy generator 10 may include in the top wall 15 of the housing 12, a mechanism or system 55 to collapse, nullify or control the electromagnetic field in the housing 12. Control mechanism 55 may also be contained within casing 2. In one embodiment, system 55 may include conductor 62 which may comprise ⅜ inch hollow metal tubing preferably having high thermal conductivity properties that is bent to form coil 60 as shown in FIGS. 11 and 12. Coil 60 is connected in series with conductor 62 and forms a closed loop 65, where a first end 63 of conductor 62 is connected to variable flow control valve 66 and a second end 64 of conductor 62 is connected to variable flow control valve 68. The valve fittings 66, 68 are connected to a swedge lock fitting 65 which is fitted in the top wall 15 of the housing 12 and positioned above the cathode emitter 32. Coil 60 and conductor 62 preferably shield emissions of radio frequency and microwave energy. The electromagnetic waves within coil 60 and conductor 62 preferably do not escape the coil 60 or conductor 62. Copper and steel are the preferred materials for coil 60 and conductor 62. Variable flow control valves 66 and 68 serve to trim or balance the plasma 27 and acoustic pressures contained within the reactor 12.

Coil 60, conductor 62, control valve 66 and 68 comprise a closed loop system 65 which conduct the microwave and radio frequency signals back into the reactor 12 thus cancelling and nullifying the microwave and radio frequency signals generated by the broadband signal generator 30 which may result in the collapse of the Radio Frequency and Microwave fields and may make the electric field potential substantially "zero" in the housing 12.

The ability to produce, maintain and control a device and system which emits a stable magnetic field having substantially no electric field potential and/or subatomic particles and/or charge-less particles has very wide spread applications in the materials processing industry, the electronics industry, the communications industry and the electronic control devices industry.

Although specific embodiments were described herein, the scope of the invention is not limited to those specific embodiments. It will be appreciated by those skilled in the art that changes could be made to the embodiments described above without departing from the broad inventive concept thereof. Thus, for example, while the preferred embodiment employs an erratically operating magnetron as the electromagnetic frequency signal generator it should be appreciated that other electromagnetic frequency generators may be used including the examples referred to and other electromagnetic frequency generators. In that regard features described herein may be used singularly or in combination as so desired. It is understood, therefore, that this invention is not limited to the particular embodiments disclosed, but it is intended to cover modifications within the spirit and scope of the present invention as defined by the appended claims and any equivalents thereof. Abstract The present invention is directed towards devices, systems and methods which produce electromagnetic waveforms including radio-frequency waves, microwaves and electromagnetic waves having no field current or electric field (magnetic waves) and subatomic and/or charge-less particles. In one embodiment, the system and method produces a "charge-less" propagating "magnetic" wave and/or charge-less particles and/or subatomic particles which have demonstrated high utility in the structural modification of both solids and liquids for materials processing. The energy generator according to one embodiment comprises a magnetron emitter hermetically sealed in a housing and supplied with a continuous dirty or erratic voltage signal to cause the magnetron emitter to operate erratically and unstably as a broad band signal generator whereby electromagnetic waves are produced in the hermetically sealed housing which facilitates and produces a plasma above the cathode of the magnetron emitter. The plasma preferably expands and contracts (oscillating) within the housing.

What is claimed is:

1. A system for producing particles and a magnetic wave, said system comprising:

a magnetron having a cathode to emit electromagnetic waves;

a power supply for providing a signal to the magnetron to make the magnetron operate erratically;

a housing having one or more walls having an inner surface, the inner surfaces forming an enclosed cavity, at least one or more of the walls being formed of or coated on the inner surface with a metal, wherein the cathode is positioned to emit electromagnetic waves into the cavity and the housing is hermetically sealed, the cathode further being positioned within the housing to produce a plasma between the cathode and one of the walls of the housing, wherein the cathode has a top surface and an outer side surface, the magnetron further being configured and positioned within the housing such that the top surface of the cathode and the wall above the top surface define an air gap spacing, the plasma being formed in the air gap spacing, the cathode further being configured and positioned within the housing to define a bleed off spacing gap which reduces the plasma field.

2. The system of claim 1, wherein the signal comprises a non-sinusoidal component with a sharp change in voltage.

3. The system of claim 1, wherein the signal is a signal selected from the group consisting of a square wave, a chopped sinusoidal wave, a clipped sinusoidal wave, and a triangularly-shaped voltage wave.

4. The system of claim 1, wherein the signal is a signal selected from the group consisting of a sinusoidal wave out of phase with at least one of a square wave, a chopped sinusoidal wave, and a clipped sinusoidal wave and a triangularly-shaped wave.

5. The system of claim 1, wherein the cathode is configured and positioned within the housing to produce an oscillating plasma field which expands and contracts.

6. The system according to claim 1, wherein the bleed-off spacing gap is less than the air space gap.

7. The system according to claim 6, wherein the ratio of the air space gap to the bleed off spacing gap is greater than or equal to 5:4.

8. The system of claim 1, wherein the housing has a top wall, back wall and at least two side walls, the cathode being positioned within the housing such that it is closest to the back wall and the back wall defines the bleed off spacing gap for quenching of the plasma.

9. The system according to claim 8, wherein the distance from the cathode to the side walls is the same as the distance from the cathode to the top wall.

10. The system of claim 8, wherein the housing further comprises a front wall, and the cathode is positioned within the housing such that the front wall is positioned further from the cathode than the back wall, the side walls or the top wall.

11. The system of claim 1, wherein the housing comprises a front wall, back wall, top wall, at least two side walls and a bottom wall and wherein the front wall is formed of a different material than at least one of the other walls.

12. The system according to claim 11 wherein the back wall, top wall, and at least two side walls are formed of or coated with metal.

13. The system of claim 1, wherein the housing further includes a throat section for improving the acceleration of the magnetic wave and the particles.

14. The system of claim 1, wherein the housing has an opening, the opening being hermetically sealed with a cover member.

15. The system according to claim 14, wherein the covering member is formed of a different material than the housing.

16. The system of claim 1, wherein the signal makes the magnetron operate erratically and produce electromagnetic waves having a frequency from at least 200 KHz to 6 GHz.

17. The system of claim 1, wherein the housing is hermetically sealed with air at one atmospheric pressure.

18. The system of claim 1, wherein the housing is hermetically sealed so that the cavity of the housing is under vacuum conditions.

19. The system of claim 1, wherein the magnetic waves includes an electric field current.

20. The system of claim 1, wherein the particles include charge-less particles.

21. The system of claim 1, wherein the particles include charged particles.

* * * * *